United States Patent [19]

Doom et al.

[11] Patent Number: 4,650,343

[45] Date of Patent: Mar. 17, 1987

[54] METHOD OF MIXING OR DRYING PARTICULATE MATERIAL

[76] Inventors: Lewis W. G. Doom, 95 Meadow Farm Rd., East Islip, N.Y. 11730; Lewis W. G. Doom, Jr., 44 Wilshire La., Apt J-18, Oakdale, N.Y. 11769; Robert W. Urban, 31 Irish La., East Islip, N.Y. 11730

[21] Appl. No.: 668,657

[22] Filed: Nov. 6, 1984

[51] Int. Cl.[4] ..... B01F 7/22

[52] U.S. Cl. ..... 366/279; 366/327; 366/330

[58] Field of Search ..... 366/279, 245, 247, 241, 366/327, 330, 147

[56] References Cited

U.S. PATENT DOCUMENTS

| | | | |
|---|---|---|---|
| 2,017,116 | 10/1935 | Bonnell | 366/327 |
| 4,310,124 | 1/1982 | Pindras | 366/330 |
| 4,479,721 | 10/1984 | Rieger | 366/327 |

FOREIGN PATENT DOCUMENTS

| | | | |
|---|---|---|---|
| 570252 | 8/1958 | Belgium | 366/327 |

*Primary Examiner*—Robert W. Jenkins
*Attorney, Agent, or Firm*—Lieberman, Rudolph & Nowak

[57] ABSTRACT

An improved method for mixing and/or drying particulate material is achieved with a housing having a substantially cylindrical portion and a tapered portion arranged coaxially therewith. A motor-driven rotor is arranged within the housing and is provided with a plurality of impeller blades which are affixed at one end to the shaft member. The impeller blades extend substantially radially outwardly toward the internal surface of the housing means. Each blade has a dual pitch characteristic which, in combination with a direction or rotation permits establishment of first and second flows of the fluidized material in opposite directions in the housing. The first and second flows are combined in the tapered section of the housing wherein there is provided a terminating impeller which agitates the combined flows in response to rotation of the central shaft. A material flow of the particulate material with sufficient velocity will fluidize the material being mixed or dryed. Fluidization of the particulate material achieves very rapid, uniform and efficient drying and/or mixing.

9 Claims, 1 Drawing Figure

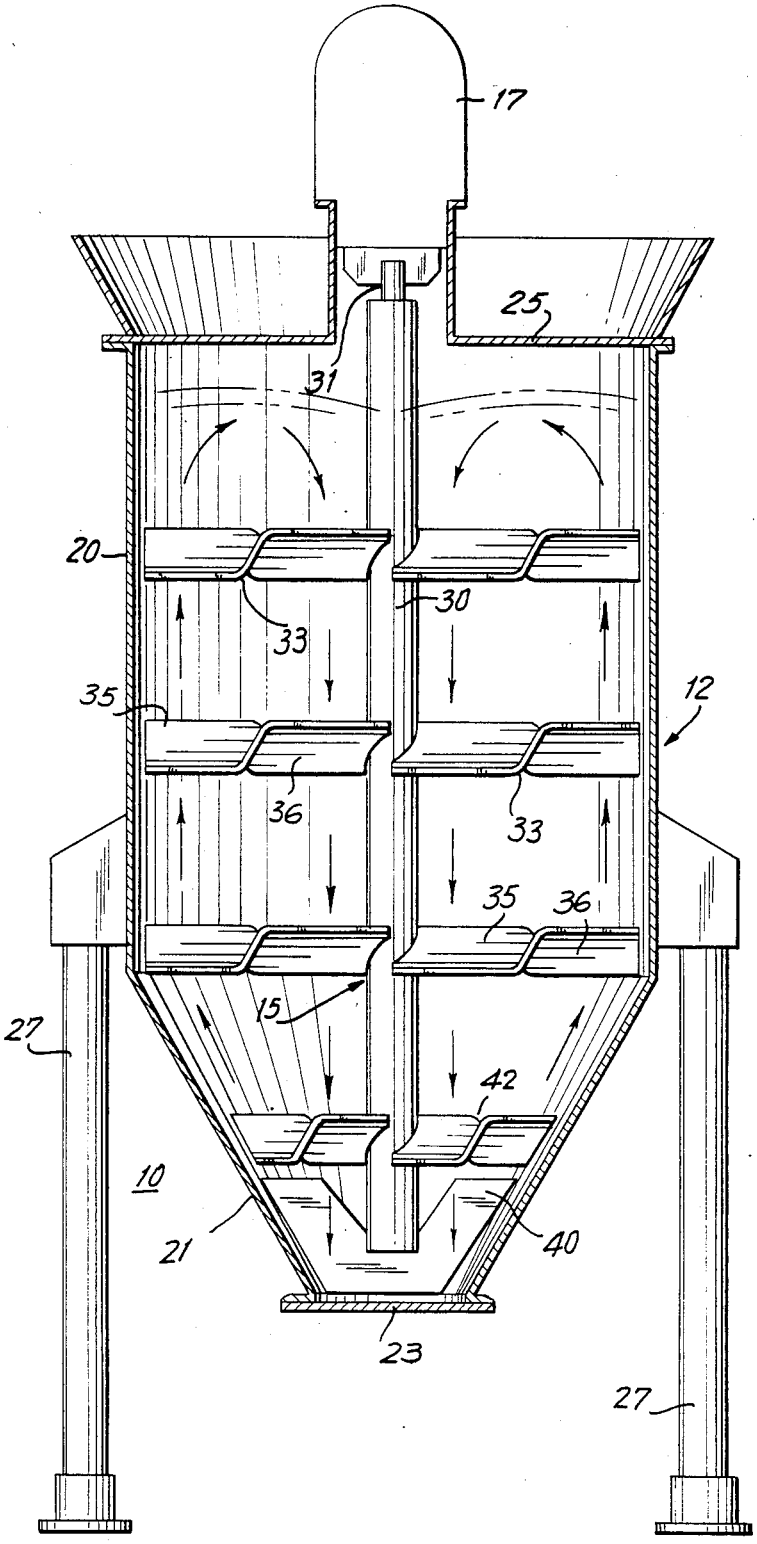
17
25
31
20
30
33
35
12
36
33
35
36
15
27
42
10
21
40
23
27

METHOD OF MIXING OR DRYING PARTICULATE MATERIAL

FIELD OF THE INVENTION

This invention relates generally to systems for mixing or drying particulate materials, such as power or granular materials and more specifically, but not limited, to a mixing and drying method for use wherein a plurality of impeller blades arranged to rotate within a container to produce first and second flows of material, the material flow designed to mechanically fluidize the particular material, fluidization being defined as to causing the particulate material to flow like a fluid.

BACKGROUND OF THE INVENTION

There is a need in the process industries for a mixing or drying method which is simple and inexpensive, and affords greater throughput by performing mixing or drying in a short amount of time. One type of prior art mixing apparatus is described in U.S. Pat. No. 4,136,972. This apparatus utilizes a plurality of elongated interdigitated rotors and stators with the rotors and stators being twisted with respect to the horizontal in order to provide rotor and stator first portions having predetermined acute angles with respect to rotor and stator second portions. The rotors cooperate with the stators to cause the material desired to be mixed to move in a flow loop down along the walls of an enclosing cylindrical container and up along the rotor shaft. Although the apparatus described in this patent has many advantages over the prior art the material flow pattern that is generated is specifically designed to minimize inclusion of air into the final mixed product and in addition finds application primarily in the mixing of liquid-liquid materials or liquid-solid materials which require complete uniformity of mix without the addition of air in a very short period of time. The search has, therefore, continued for an improved mixing/drying device applicable to other materials.

Accordingly, it is an object of this invention to provide a simple and inexpensive or drying method for particulate materials.

It is a further object of this invention to provide a mixing or drying method which achieves the mixing or drying in a shorter period of time than known arrangements.

It is another object of this invention to provide a mixing or drying method for particulate material which does not require the use of stator blades.

It is a still further object of this invention to provide a mixing or drying method which can be utilized for batch or continuous mixing of any particulate material.

SUMMARY OF THE INVENTION

The foregoing and other objects are achieved by the instant invention which provides a unique and improved method for mixing or drying particulate materials. In accordance with a first aspect of the invention, a housing is provided with an internal surface arranged around a longitudinal central axis and disposed at a predetermined radial distance therefrom. The housing may, but does not necessarily, contain a tapered portion which abuts the internal surface and is provided with a tapered internal surface. Inside the housing there is provided a rotatable shaft member, arranged substantially coincidentally with the longitudinal central axis of the housing and having a plurality of impeller blades affixed to the shaft member so as to extend outwardly toward the internal surface. The direction of rotation of the rotatable shaft member and the pitch characteristic of the impeller blades may be chosen so that the material to be mixed or dryed is urged along first and second longitudinal directions within the housing to create a flow of particulate material to be mixed or dryed. The material flow may be downward in a direction parallel to the rotatable shaft member and upward along the internal surface of the housing or may be in the opposite direction. Regardless of the direction of material flow, the speed of rotation for the rotatable shaft member is chosen such that the resultant movement of the particulate material serves to fluidize the material being mixed or dryed. Fluidization of the particulate material by mechanical means serves to provide rapid mixing or drying with complete uniformity of the final product, the inventive method being suitable for either batch or continuous operation.

In accordance with one aspect of the invention, a volumetric region in the vicinity of the shaft of the rotor contains the fluidized material flowing in a longitudinal direction toward the tapered portion of the housing. The region in the vicinity of the internal surface of the housing, therefore, contains fluidized material flowing in the direction away from the tapered portion of the housing. To assist in a smooth transition of the fluidized material flow between the tapered and substantially cylindrical portions of the housing, at least one of the impeller blades may be arranged in the longitudinal vicinity of the juncture between the cylindrical and tapered portions. In one embodiment, the impeller blades themselves may be tapered so as to have a width which diminishes with radial extent toward the cylindrical internal surface.

In accordance with a second and further aspect of the invention, particulate material desired to be mixed is fluidized in a longitudinal container having a first section having the aforementioned substantially constant cross-sectional with respect to distance along a longitudinal axis, and a second section having a decreasing cross-sectional area. A first flow of the fluidized particulate material is established longitudinally along the first section of the container in a direction toward the second, or tapered, section. A second flow of the fluidized particulate materials is established longitudinally in a direction away from the second section of the container. Agitation is produced in the second section of the longitudinal container where the first and second flows of fluidized particulate materials are combined.

In accordance with the drying aspect of the invention, dry and/or dry/warm air may be introduced into the housing such that the particulate material is fluidized by such dry or dry/warm air with the result of rapidly drying the particulate material as it is mixed. In yet another embodiment of the drying aspect of the invention the housing may be sealed and evacuated to create a partial vacuum within the sealed housing. The moist air appearing in the housing, as the particulate material is mixed, is then drawn off to dry the material during the mixing process.

BRIEF DESCRIPTION OF THE DRAWINGS

Comprehension of the invention is facilitated by reading the following detailed description in conjunction with the annexed drawing which is a simplified schematic representation of a mixing apparatus constructed in accordance with the principles of the invention.

DETAILED DESCRIPTION

The FIGURE shows a mixing or drying apparatus 10 formed of a housing 12 having a rotor assembly 15 therewithin. Rotor assembly 15 is arranged to rotate within housing 12 in response to a rotational force applied by a motor or other mechanical driving means 17.

Housing 12 of apparatus 10 is formed of a substantially cylindrical housing section 20 and a tapered housing section 21. Tapered housing section 21 is joined with substantially cylindrical housing section 20, and in this specific embodiment, the tapered housing section has a truncated conical shape. The housing is closed at the bottom thereof with a removeable closure plate 23, and at the top by a cover 25. It is, of course, understood that plate 23 could be replaced with a valving arrangement. In this embodiment, the apparatus is supported by a plurality of stands 27 such that a central longitudinal axis of the apparatus is vertically disposed. However, the method of the instant invention can be utilized in other orientations, including horizontally or inverted, and including mounting motor 17 at the bottom of the housing 12.

Rotor assembly 15 is formed of a central shaft 30 which is coupled to motor 17 via a coupler 31. In certain embodiments of the invention where cover 25 is desired to be removable, the cover may include a hinge hatch or coupler 31 may be of a type which permits decoupling of the motor and central shaft so as not to require the entire rotor assembly to be removed with the cover and motor.

A plurality of impeller blades 33 are provided as part of the rotor assembly and are coupled at one end thereof to central shaft 30. The impeller blades therefore extend radially outward from central shaft 30 toward the internal surface of substantially cylindrical housing section 20. The impeller blades are each of a type having dual pitch characteristics. Thus, for a given direction of rotation, each blade will cause flow in one direction for a given radial distance, and in a second direction beyond that radial distance. As shown in the drawing, each impeller blade may have a first portion 35 and a second portion 36. It is, of course understood that the impeller blades may be of varius other designs than depicted. Assuming a counter clockwise direction of rotation for central shaft 30, as viewed from the top, any fluidizable particulate material (not shown) within housing 12 would experience motion in the direction of the arrows. More specifically, the fludizable material in the region of central shaft 30 would, in this embodiment, experience a downward flow toward the tapered housing section, while the fluidizable material in the vicinity of the internal surface of the substantially cylindrical housing section would experience an upward flow. Thus, when viewed crosssectionally, the downward flow has a substantially cylindrical configuration surrounding the central shaft, and the upward flow as a substantially annular configuration surrounding the downward flow. It is, of course, understood that material flow could be in the opposite direction of that shown in the FIGURE by proper selection of the direction of rotation of shaft 30 and/or proper selection of the pitch characteristics of the impeller blades.

In the embodiment of the invention shown in the FIGURE, a terminating impeller 40 is affixed to the lower most end of central shaft 30. Thus, as the downward flow is combined with the upward flow at the terminating impeller, the rotation of terminating impeller 40 results in an agitation which improves the mixing/drying process. An advantageous intermediate impeller 42 is affixed to central shaft 30 and arranged intermediate of impeller blades 33 and terminating impeller 40. It is to be understood that impeller blades 33, and intermediate impeller 42, need not be arranged within the housing in the manner indicated in the FIGURE. It is contemplated within the scope of the present invention that the various impeller blades may be staggered on central shaft 30. Additionally, the blades may be arranged at various angles with respect to one another. Thus, for example, additional sets of impeller blades, or an intermediate impeller blades may be arranged orthogonal to those shown in the drawing. Persons of skill in the art would readily understand such an arrangement.

The various impeller blades and the intermediate impeller blades may themselves be tapered (such tapering not shown) such that the blades have a smaller cross-sectional dimension in the vicinity of the internal surface of the housing. Additionally, a set of impeller blades 33 may be arranged longitudinally in the vicinity of the juncture between the substantially cylindrical and tapered housing sections so as to insure a smooth transition of the upward and downward flows.

As stated above, the direction of material flow in the FIGURE, as shown by the arrows, is exemplary and could be reversed by proper selection of the pitch of the impeller blades, or by the direction of rotation. Regardless of the direction of material flow, what is necessary for the practice of the invention is fluidization of the particulate material within housing 12, achieved by introducing sufficient velocity into the particulate material by a mechanical mixing process.

Although speed of rotation of central shaft 30 is not crucial to practice of the invention, it must be sufficient to obtain fluidization of the particulate material. The rotational speed to achieve fluidization will vary depending on the particulate material being mixed. Examples which have achieved fluidization along with attendant rapid and uniform mixing include the following:

EXAMPLE 1

Particulate materials—flour and sugar.
Housing diameter—16 inches.
Speed of rotation—150 r.p.m. or higher.
Mixing time—8 to 15 seconds.
Composition of mixed material—uniform.

EXAMPLE 2

Particulate materials—flour and sugar.
Housing diameter—8 inches.
Speed of rotation—300 r.p.m. or higher.
Mixing time—8 to 10 seconds.
Composition of mixed material—uniform.

EXAMPLE 3

Particulate materials—sand and cememt.
Housing diameter—16 inches.
Speed of rotation—100 r.p.m. or higher.
Mixing time—7 to 10 seconds.
Composition of mixed material—uniform.

EXAMPLE 4

Particulate materials—sand and cement.
Housing diameter—8 inches.

Speed of rotation—200 r.p.m. or higher.
Mixing time—6 to 10 seconds.
Composition of mixed material—uniform.

EXAMPLE 5

Particulate materials—milk powder and cocoa powder.
Housing diameter—16 inches.
Speed of rotation—125 r.p.m. or higher.
Composition of mixed material—uniform.

EXAMPLE 6

Particulate materials—milk powder and cocoa powder.
Housing diameter—8 inches.
Speed of rotation—150 r.p.m. or higher.
Composition of mixed material—uniform.

As indicated above, the inventive process described herein can accomplish drying particulate material as well as mixing particulate material. Examples of utilizing the process for drying as well as mixing would include the introduction of dry and/or warm/dry air into housing 12 by means of an orifice in the housing. The introduction of dry and/or warm/dry air into the housing prior to and/or during fluidization of the particulate material would rapidly dry the material as it is mixed. A second embodiment of the invention for use as a drying process would include sealing housing 12 and then evacuating the air in the housing to achieve a partial vacuum. During the mixing process any moist air and/or water vapor released from the particulate material would be drawn off to dry the particulate material being mixed.

Although the invention has been described in terms of specific embodiments and applications, persons of skill in this art, in light of this teaching, can generate additional embodiments without exceeding the scope or departing from the spirit of the claimed invention. For example, such persons of skill in the art can readily understand the manner in which the subject invention can be utilized to effect either batch or continuous mixing processes. Accordingly, it is to be understood that the drawing and description in this disclosure are proffered to facilitate comprehension of the invention and should not be construed to limit the scope thereof.

What is claimed is:

1. A method of mixing particulate materials, the method comprising the steps of:

placing the particulate materials within a longitudinal container, mechanically moving said particulate material within said longitudinal container by rotating a plurality of impeller blades having a twisted configuration so as to cause flow of said material in one direction for a given radial distance of said blades, and in a second direction beyond said radial distance, fluidizing the said particulate material in said longitudinal container having a first section with a substantially constant cross-sectional area with respect to distance along a longitudinal axis of said longitudinal container and a second section having a decreasing cross-sectional area with respect to distance along said longitudinal axis;

establishing a second flow of said fluidized particulate materials longitudinally along said first section of said longitudinal container in a direction away from said second section thereof, said second flow having a predetermined second flow cross-sectional area; and combining said first and second flows in said second section of said longitudinal container.

2. The method of claim 1 wherein there is provided the further step of agitating said combined first and second flows in said second section of said longitudinal container whereby said first flow is returned as said second flow after said agitation.

3. The method of claim 1 wherein there is provided the further step of continuing said first and second flows in said second section of said longitudinal container.

4. The method of claim 1 wherein said steps of establishing said first and second flows comprise the further step of rotating a rotor having at least one impeller blade in said first section of said longitudinal container.

5. The method of claim 4 wherein said impeller blade is formed of first and second blade sections for said first and second flows, respectively.

6. The method of claim 1 wherein said first flow of said fluidized particulate material has a cross-sectional configuration which is substantially cylindrical with respect to said direction of flow.

7. The method of claim 6 wherein said second flow of said fluidized particulate material has a cross-sectional configuration which is substantially annular with respect to said direction of flow, said first flow being surrounded cross-sectionally by said second flow in said first section of said longitudinal container.

8. The method of claim 1 wherein there is provided the further step of removing a predetermined component of said fluidized particulate material from said established flows.

9. The method of claim 8 wherein said step of removing a predetermined component comprises the drying of the particulate material during mixing.

* * * * *